US008555424B2

(12) United States Patent
Higgins

(10) Patent No.: US 8,555,424 B2
(45) Date of Patent: Oct. 15, 2013

(54) HELMET HAVING A GUIDING MECHANISM FOR A COMPATIBLE VISOR

(76) Inventor: Danny Higgins, St-Basile-le-Grand (CA)

( * ) Notice: Subject to any disclaimer, the term of this patent is extended or adjusted under 35 U.S.C. 154(b) by 93 days.

(21) Appl. No.: 13/365,416

(22) Filed: Feb. 3, 2012

(65) Prior Publication Data

US 2012/0185989 A1 Jul. 26, 2012

Related U.S. Application Data

(63) Continuation-in-part of application No. 12/720,195, filed on Mar. 9, 2010, now Pat. No. 8,286,270.

(30) Foreign Application Priority Data

Mar. 16, 2009 (CA) ..... 2658238

(51) Int. Cl.
*A42B 1/24* (2006.01)

(52) U.S. Cl.
USPC ..... 2/422; 2/6.2; 2/6.7; 2/424; 2/15

(58) Field of Classification Search
USPC ..... 2/410, 5, 6.1–6.7, 422, 424–428, 206, 2/209.13
See application file for complete search history.

(56) References Cited

U.S. PATENT DOCUMENTS

| | | | |
|---|---|---|---|
| 2,301,050 | A | 11/1942 | Kelley |
| 2,302,231 | A | 11/1942 | Lobelle |
| 2,649,019 | A | 8/1953 | Hartline |
| 2,762,051 | A | 9/1956 | Finken |
| 2,903,700 | A | 9/1959 | Finken |
| 2,939,458 | A | 5/1960 | Luisada |
| 3,066,305 | A | 12/1962 | Aileo |
| 3,081,460 | A | 3/1963 | Miller |
| 3,128,469 | A | 4/1964 | Lobelle |

(Continued)

FOREIGN PATENT DOCUMENTS

| | | | |
|---|---|---|---|
| DE | 29915934 | U1 | 7/2000 |
| EP | 0603027 | B1 | 6/1994 |

(Continued)

*Primary Examiner* — Danny Worrell
(74) *Attorney, Agent, or Firm* — Benoît & côté Inc.; Danny Higgins

(57) ABSTRACT

A helmet comprises a shell, a visor, a face seal, a biasing means and two guiding mechanisms. The two guiding mechanisms, each located on a different side of the shell, connect the visor to the shell. Under a bias of the biasing means, the guiding mechanisms are operative to guide the visor along a pre-determined trajectory defined by the geometry of the guiding mechanisms. Each one of the two guiding mechanisms is further provided with a guiding track arrangement which comprises a first track portion and a second track portion. The first slider slidingly engages the first track portion while the second slider slidingly engages the second track portion. The pre-determined trajectory extends from a retracted position where the visor is substantially proximate a front portion of the shell and substantially outside a field of view of the wearer to a deployed position where the visor is substantially below the frontal lower edge and within the field of view of the wearer, and further towards a rear portion of the helmet to a resting position aft of the deployed position. In use, the face seal, which is located at a lower portion of the visor, is operative to substantially perpendicularly contact a face of the wearer at a position between the deployed position and the resting position.

19 Claims, 13 Drawing Sheets

(56) References Cited

U.S. PATENT DOCUMENTS

| | | | | |
|---|---|---|---|---|
| 3,262,125 | A | 7/1966 | Bowen | |
| 3,473,166 | A | 10/1969 | Lobelle | |
| 3,601,813 | A | 8/1971 | Aileo | |
| 3,636,565 | A | 1/1972 | Luisada | |
| 3,691,565 | A | 9/1972 | Galonek | |
| 4,224,694 | A | 9/1980 | Palmaer | |
| 4,287,615 | A | 9/1981 | Morin | |
| 4,432,100 | A | 2/1984 | Bates | |
| 4,686,712 | A | 8/1987 | Spiva | |
| 4,907,300 | A | 3/1990 | Dampney | |
| 5,012,528 | A | 5/1991 | Pernicka | |
| 5,752,280 | A | 5/1998 | Hill | |
| 6,094,751 | A | 8/2000 | Parks | |
| 6,119,276 | A | 9/2000 | Newcomb | |
| 6,282,726 | B1 | 9/2001 | Noyerie | |
| 6,804,829 | B2 | 10/2004 | Crye | |
| 6,845,548 | B1 | 1/2005 | Lin | |
| 8,286,270 | B2 * | 10/2012 | Higgins | 2/422 |
| 8,321,962 | B2 * | 12/2012 | Moyses | 2/8.2 |
| 2004/0143879 | A1 | 7/2004 | Robertson | |
| 2008/0072364 | A1 | 3/2008 | Schimpf | |
| 2008/0263754 | A1 | 10/2008 | Folkesson | |
| 2009/0313745 | A1 | 12/2009 | Kang | |

FOREIGN PATENT DOCUMENTS

| | | |
|---|---|---|
| EP | 0668029 Al | 8/1995 |
| EP | 1312274 Al | 5/2003 |
| FR | 2717046 | 9/1995 |
| FR | 2840778 Al | 12/2003 |
| JP | 10212618 A | 8/1995 |

* cited by examiner

HELMET HAVING A GUIDING MECHANISM FOR A COMPATIBLE VISOR

This application is a Continuation-in-part of U.S. patent application Ser. No. 12/720,195 filed Mar. 9, 2010.

FIELD OF THE INVENTION

The present invention generally relates to the field of helmets. More specifically, the invention relates to a helmet having a guiding mechanism for a compatible visor for use in sports, such as skiing or other activities where it is advantageous to position the visor close to the face of a wearer.

BACKGROUND OF THE INVENTION

The use of protective gear in activities, such as some sports, containing some risk is always recommended. Although occurrence of a serious accident may sometimes be remote, people are becoming more aware that if such accident happens, head injuries are among the most serious injuries a person may suffer. Fortunately, with improved designs, reduced weight and increased comfort, protective helmets have gained tremendous popularity in recent years, especially in sports such as biking and downhill skiing.

Because of wind and cold, skiers very often wear goggles over their helmet. Unfortunately, this is not the most convenient design as wind may infiltrate in between the helmet and the goggles, freezing a wearer's forehead. This is especially true if there is a less than perfect match between the helmet and the goggles.

Furthermore, when the skier gets to the bottom of the slopes and waits in line for the chairlifts, he often takes his goggles off, letting them rest in equilibrium on a front portion of the helmet, retained by the goggles' elastic band. However, if the goggles are not perfectly positioned, they will often either flip up and end up retained by a retaining strap at the back of the helmet, or flip down, striking the eyes of the wearer completely caught off guard.

To mitigate these inconveniences, interesting solutions have been proposed. U.S. Pat. No. 4,287,615 to Morin discloses a ski helmet having an integrated withdrawable visor. The visor is moveable between a deployed position within a wearer's field of view for use of the visor and a retracted position behind a helmet shell. As the visor is deployed, its edges follow a guiding surface against which it is biased by a spring. As the visor reaches its fully deployed position, the guiding surface is made so that the visor moves towards a face of the wearer, sealing his eyes against wind infiltration. However, the movement required to move the visor is not natural as the wearer is required to move a lever, located at the base of the helmet, towards the front to retract the visor and towards the back to deploy the visor. Furthermore, if the wearer intends to retract the visor with a more natural movement, such as by grabbing a bottom portion of the visor with his thumb and pushing up the visor, the visor will likely not retract properly as the wearer, wearing thick gloves or mittens, will often lift the visor too much forward, off its guiding surfaces, resulting in rubbing the visor against the helmet shell and preventing it from retracting properly in its pocket, located between the helmet shell and a helmet liner.

U.S. Pat. No. 6,804,829 to Crye et al. describes a combat helmet. The combat helmet, among others, comprises a retractable visor. The visor is pivotally attached to the helmet and is moveable in an arcuate path between a deployed position within the field of view of the wearer and a retracted position behind a helmet shell. However, because the visor moves in a simple arcuate path, the visor engages the face of the wearer with a downward pressure, thereby providing an unpleasant feeling. Moreover, this downward motion of the shield does not efficiently seal the shield against the face of the wearer.

There is therefore a need for an improved helmet that integrates a visor but that does not have the shortcomings of the prior art.

SUMMARY OF THE INVENTION

It is an object of the present invention to provide a helmet that overcomes or mitigates one or more shortcomings of known helmets, or at least provide a useful alternative.

The invention provides the advantages of conveniently integrating a visor with a helmet where the visor may be moved along a pre-determined trajectory so that the visor is operative to seal substantially normally against the face of a wearer under a force generated by a biasing means, while still being retractable either within or over a front portion of the helmet.

In accordance with a first embodiment of the invention, there is provided a helmet comprising a shell, a visor, a face seal, a biasing means and two guiding mechanisms. The shell is adapted to contact a wearer's head. It has a shell front portion which has a frontal lower edge. The visor has a visor upper portion and a visor lower portion to which is connected the face seal. The two guiding mechanisms are each located on a different side of the shell and connect the visor to the shell. The guiding mechanisms are operative to guide the visor along a pre-determined trajectory that is defined by the geometry of the guiding mechanisms. The pre-determined trajectory has a deployment trajectory and a translation trajectory. Each one of the two guiding mechanisms is further provided with a guiding track arrangement which comprises a first track portion and a second track portion. The first track portion has a deployment portion and a translation portion. Both the translation portion and the second track portion at least partly extend substantially parallel to the longitudinal axis. The first slider slidingly engages the first track portion while the second slider slidingly engages the second track portion. The guiding mechanisms are operative to guide the visor along the deployment trajectory when the first slider is within the deployment portion of the first track portion. The deployment trajectory extends from a retracted position where the visor is substantially proximate the shell front portion and substantially outside a field of view of the wearer to a deployed position where the visor is substantially below the frontal lower edge and within the field of view of the wearer. The guiding mechanisms are further operative to guide the visor along the translation trajectory when the first slider is within the translation portion of the first track portion. The translation trajectory extends substantially parallel to the longitudinal axis, from the deployed position to a resting position aft of the deployed position. The biasing means is operative to bias the visor towards the deployed position and further towards the resting position so that in use the face seal is operative to substantially perpendicularly contact a face of the wearer, thereby defining a contacting position. The contacting position is located along the translation trajectory between the deployed position and the resting position.

Optionally, the helmet may further comprise an upper seal connected to either the shell or the visor upper portion. The upper seal is located below and at least partially recessed from the frontal lower edge when the visor is in the deployed position. The upper seal is operative to seal the visor upper portion against the shell. The upper seal may be adapted to seal in a transverse plane.

The shell of the helmet may comprise an outer shell and an inner shell inside the outer shell. The inner shell is made of an impact-absorbing material. Advantageously, the upper seal may be connected to the inner shell.

The first track portion may further comprise a locking portion connected to the deployment portion. The locking portion is oriented so that the biasing means biases the first slider towards the end of the locking portion distal the deployment portion.

Optionally, the guiding mechanisms may further comprise a visor adaptor. Advantageously, the visor is removably connected to the shell through the visor adaptor and the biasing means connects the visor adaptor to the shell. This allows for the removal of the visor without having to disconnect the biasing means from the visor.

Optionally, the first track portion may be located on the visor adaptor while the first slider is located on the shell. Similarly, the second track portion may also be located on the visor adaptor while the second slider is located on the shell.

In a variation of the embodiment of the present invention, the first slider is located fore and above of the second slider. The deployment portion is then curved upwardly and rearwardly from the translation portion.

Each of the guiding mechanisms may comprises a base which is inserted in the inner shell. When this is so, the first slider and the second slider may be located on the base.

Advantageously, the two sides of the visor may be free from having seals. This allows a broader field of view.

Optionally, the visor may further comprise a lower frame that runs along the visor lower portion and that connects the face seal to the visor. The lower frame is provided with ventilation opening to allow air to circulate on the inside of the visor surface while allowing humidity to exit from the inside of the visor, thereby preventing a lens of the visor from fogging.

Conveniently, the helmet may further be equipped with a sun visor located on the visor, proximate the visor upper portion.

In accordance with another embodiment of the invention, there is provided a helmet comprising a shell, a visor, a face seal connected to a lower portion of the visor, two guiding mechanisms and a biasing means. Each one of the two guiding mechanisms are located on a different side of the shell and connect the visor to the shell. Through a guiding track arrangement, each one of the guiding mechanism is operative to guide the visor along a pre-determined trajectory. The biasing means is operative to bias the visor along the pre-determined trajectory. The pre-determined trajectory extends from a retracted position where the visor is substantially proximate a front portion of the shell and substantially outside a field of view of the wearer to a contacting position where the visor is substantially below a frontal lower edge of the front portion of the shell and within the field of view of the wearer. The pre-determined trajectory extends substantially parallel to a longitudinal axis of the shell in the proximity of the contacting position. The biasing means is operative to bias the visor towards the contacting position so that in use, the lower seal is operative to substantially perpendicularly contact a face of the wearer under the bias of the biasing means.

The guiding track arrangement may comprise a first track portion and a second track portion. The first track portion has a deployment portion and a translation portion. The translation portion and the second track portion at least partially extend substantially parallel to the longitudinal axis of the shell. Each guiding mechanism comprises a first slider and a second slider. The first slider slidingly engages the first track portion while the second slider slidingly engages the second track portion. For example, the first track portion and the second track portion may be located on the visor adaptor and the first slider and the second slider may be located on the shell. If the first slider is located below and aft of the second slider, the deployment portion is curved upwardly and rearwardly from the translation portion.

The helmet may also comprise an upper seal connected to either the shell or the upper portion of the visor. The upper seal is located below and at least partially recessed from the frontal lower edge when the visor is in the contacting position. The upper seal is operative to seal the visor upper portion against the shell. The upper seal may be adapted to seal in a transverse plane.

The shell may comprise an outer shell and an inner shell inside the outer shell. The inner shell is typically made of an impact-absorbing material and the upper seal is connected to the inner shell.

Optionally, the first track portion further comprises a locking portion connected to the deployment portion, the locking portion being oriented so that the biasing means biases the first slider towards the end of the locking portion distal the deployment portion.

Each one of the guiding mechanisms may further comprises a visor adaptor that removably connects the visor to the shell. The biasing means connects the visor adaptor to the shell.

BRIEF DESCRIPTION OF DRAWINGS

These and other features of the present invention will become more apparent from the following description in which reference is made to the appended drawings wherein.

DETAILED DESCRIPTION OF THE INVENTION

The present invention relates to a helmet incorporating a visor that is guided along a pre-determined trajectory and that is capable of sealing against a face of a wearer. The visor moves along a pre-determined trajectory from a retracted position proximate a front portion of the helmet and substantially outside a field of view of the wearer to a deployed position substantially below a frontal lower edge and substantially within the field of view of a wearer and further to a resting position. The visor is guided so that the visor contacts the face of the wearer in a direction that is predominantly along a longitudinal axis of the helmet and substantially oriented towards a back of the helmet so that a face seal at a lower portion of the visor seals against the face of the wearer with a pressure, applied by a biasing means, substantially normal to the face. When the visor is moved back to its retracted position, it is guided so that it may lock into place, preventing unwanted movement back to the deployed position and further to the resting position.

The helmet described herein may be used in many types of applications, sometimes with variations in its impact-absorbing structure. For example, the helmet of the present invention may be used in many activities such as skiing, biking, motorcycling, or for other professional uses such as police, firefighter or military applications.

Although the helmet of the present invention may be provided without the visor, the description will be made with respect to the helmet already equipped with the visor since it will most often be used as such. For example, the helmet of the present invention could be provided with a pre-installed visor, or as a kit. Furthermore, although the helmet is depicted in the figures as being of an open-face type, the invention may optionally be adapted to other types of helmets such as motocross helmets.

Figure 1:
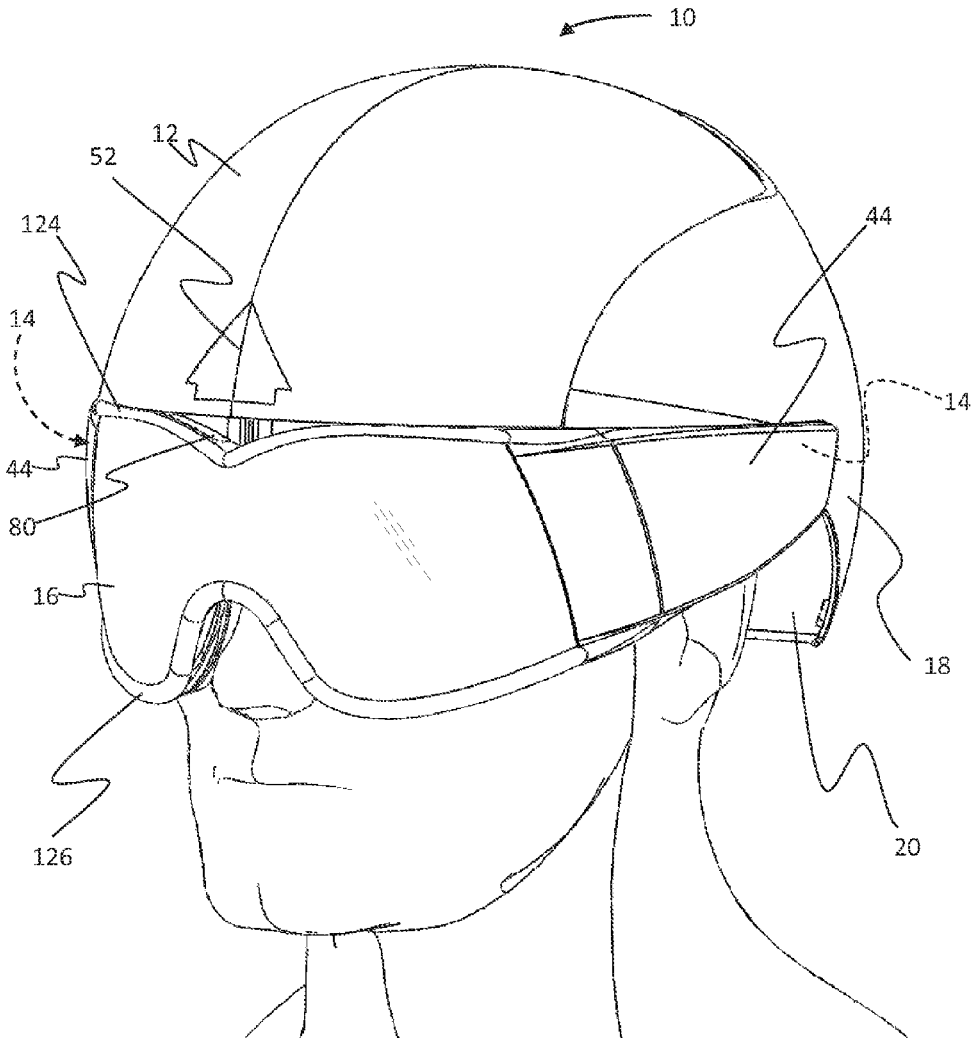
FIG. 1 is an axonometric front view of a helmet with its visor in a contacting position in accordance with an embodiment of the present invention.
Figure 2:
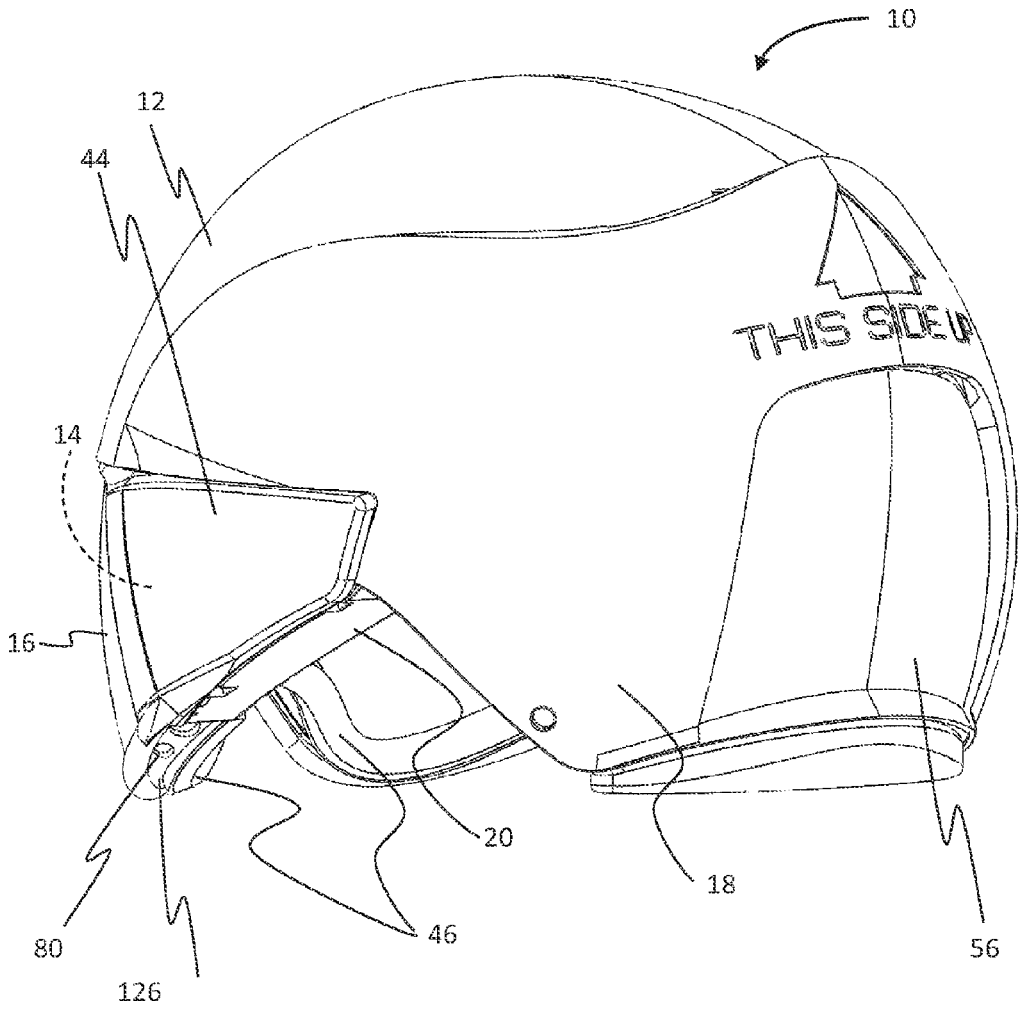
FIG. 2 is an axonometric rear view of the helmet of FIG. 1.

FIGS. 1 and 2, now concurrently referred to, depict a helmet 10 according to a first embodiment of the present invention. The helmet 10 comprises a shell 12, two guiding mechanisms 14 (one on each side of the helmet 10, now hidden under a cover 44 but best shown in FIG. 3, now concurrently referred to), a visor 16 and a face seal 46, best shown in FIG. 2, connected to a lower portion of the visor 16.

Figure 5A:
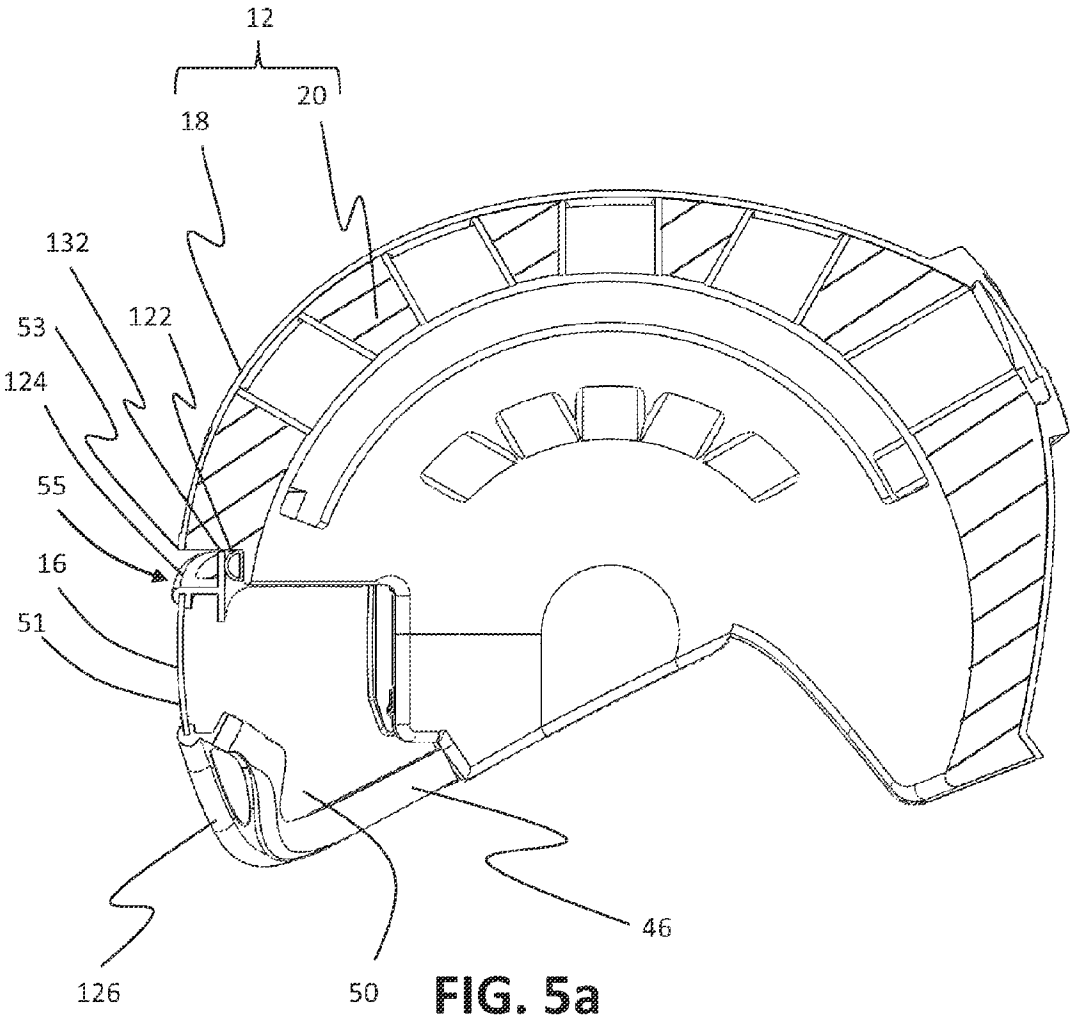
FIG. 5*a* is a cross-section view of the helmet of FIG. 1.

The shell 12, which has a front portion 52 and a rear portion 56, is operative to contact a wearer's head and to protect the head by absorbing the energy from an unfortunate impact. The shell 12 typically comprises an outer shell 18, on the exterior of the shell 12 and which is mostly used to distribute the impact over a larger area while providing a nice exterior cosmetic appearance, and an impact energy absorbing inner shell 20, inside the outer shell 18. The inner shell 20 fits the head of the wearer and is used to absorb most of the impact energy by deformation so that as little energy as possible is transferred to the head. Typically, an impact-absorbing material such as a high-density foam is used as the inner shell material. The inner shell 18 and the outer shell 20 are best depicted in FIG. 5*a*.

The visor 16 comprises a lens 51 and is equipped with the face seal 46 in its lower portion 50. The visor 16 may use a lower frame 126 that runs along the visor lower portion 50 and that connects the face seal 46 to the visor 16. The lower frame 126 may be provided with one or more ventilation openings 80 that slightly ventilate the interior of the visor 16, thereby preventing fogging. Similarly, the visor 16 may use an upper frame 124 which runs along a visor upper portion 55. The upper frame 124 may also be provided with ventilation openings 80 to slightly ventilate the interior of the visor 16. The lens 51 may use a coating to prevent fogging or may be double-walled to also prevent fogging.

The face seal 46 protects the wearer against cold air intrusion or any other element that could infiltrate in between the visor 16 and the face of the wearer. Hence, the face seal 46 improves the comfort of the wearer. The face seal 46 is similar to the face seals of conventional goggles, except that it does not have to completely surround the visor 16 as in conventional goggles. Indeed, no seal is needed on the sides of the visor 16 as covers 44 may cover the guiding mechanisms 14 and thereby prevent elements from reaching the face of the wearer from the sides of the helmet 10. Hence, the visor 16 may be devoid from having a seal along its sides. Advantageously, freeing the visor 16 from lateral seals provide more room, which in turn allows wearers of prescription glasses wearers to wear their glasses with the present helmet 10. The face seal 46 is typically made of a soft, resilient plastic and may comprise soft foam to comfortably contact the face of the wearer.

Figure 3:
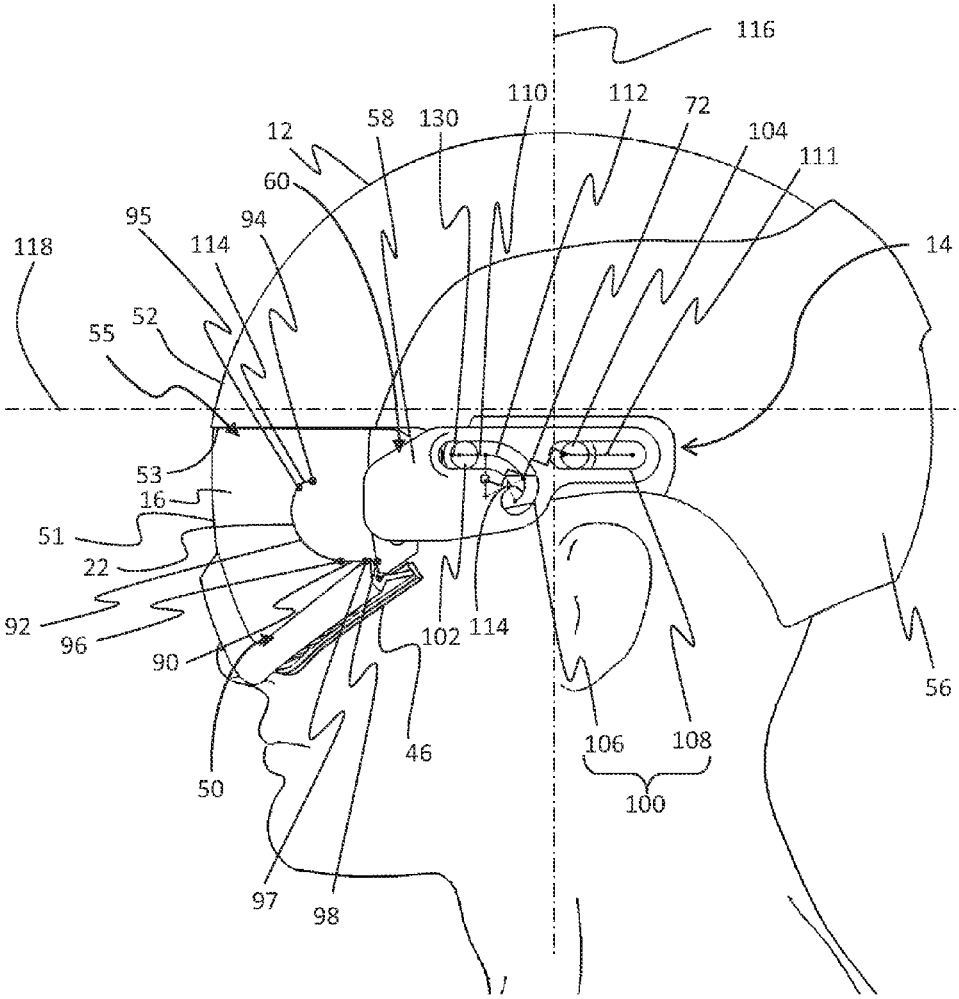
FIG. 3 is a side view of the helmet of FIG. 1, without a visor cover, showing both the detail of a left guiding mechanism and of a trajectory followed by a virtual reference point located at a lower portion of the visor, which is shown in its contacting position, in accordance with another embodiment of the present invention.

FIG. 3 shows the left guiding mechanism 14. It will be understood that the right guiding mechanism 14 is a mirror image of the left guiding mechanism 14. Each guiding mechanism 14 is adapted to receive and to guide the visor 16 along a pre-determined trajectory 22.

For reference purposes, the shell 12 has been given a vertical axis 116 and a longitudinal axis 118. Each one of the two guiding mechanisms 14 comprises a guiding track arrangement 100, a first slider 102 and a second slider 104. The guiding track arrangement 100 is made of two portions, a first track portion 106 and a second track portion 108. The first and the second track portions 106, 108 may be separate, as shown in FIG. 3, or could be merged into a single guiding track arrangement 100 if the geometry allows it. The first slider 102 and the second slider 104 respectively engage the first track portion 106 and the second track portion 108 and each slider 102, 104 is operative to slide within its respective track portion. Conveniently, the first and second sliders 102, 104 have a cylindrical shape so as to be adapted to both slide within, and rotate with respect to, respectively the first and the second track portion 106, 108. It may be noticed that the first slider 102 is located fore of the second slider 104. With other guiding track arrangement geometries though, the second slider 104 could be located fore of the first slider 102. The location of the first and second sliders 102, 104 and the shape of the first and second track portions 106, 108 define the geometry of the guiding mechanism 14. This geometry itself defines the pre-determined trajectory 22 along which the visor 16 is guided.

The first track portion 106 sequentially comprises a translation portion 110, a deployment portion 112 and an optional locking portion 114. As can be seen, both the translation portion 110 and the second track portion 108 at least partially extend predominantly parallel to the longitudinal axis 118. This allows the guiding mechanism 14 to guide the visor 16 predominantly along a pre-determined distance along the longitudinal axis 118.

Figure 7:
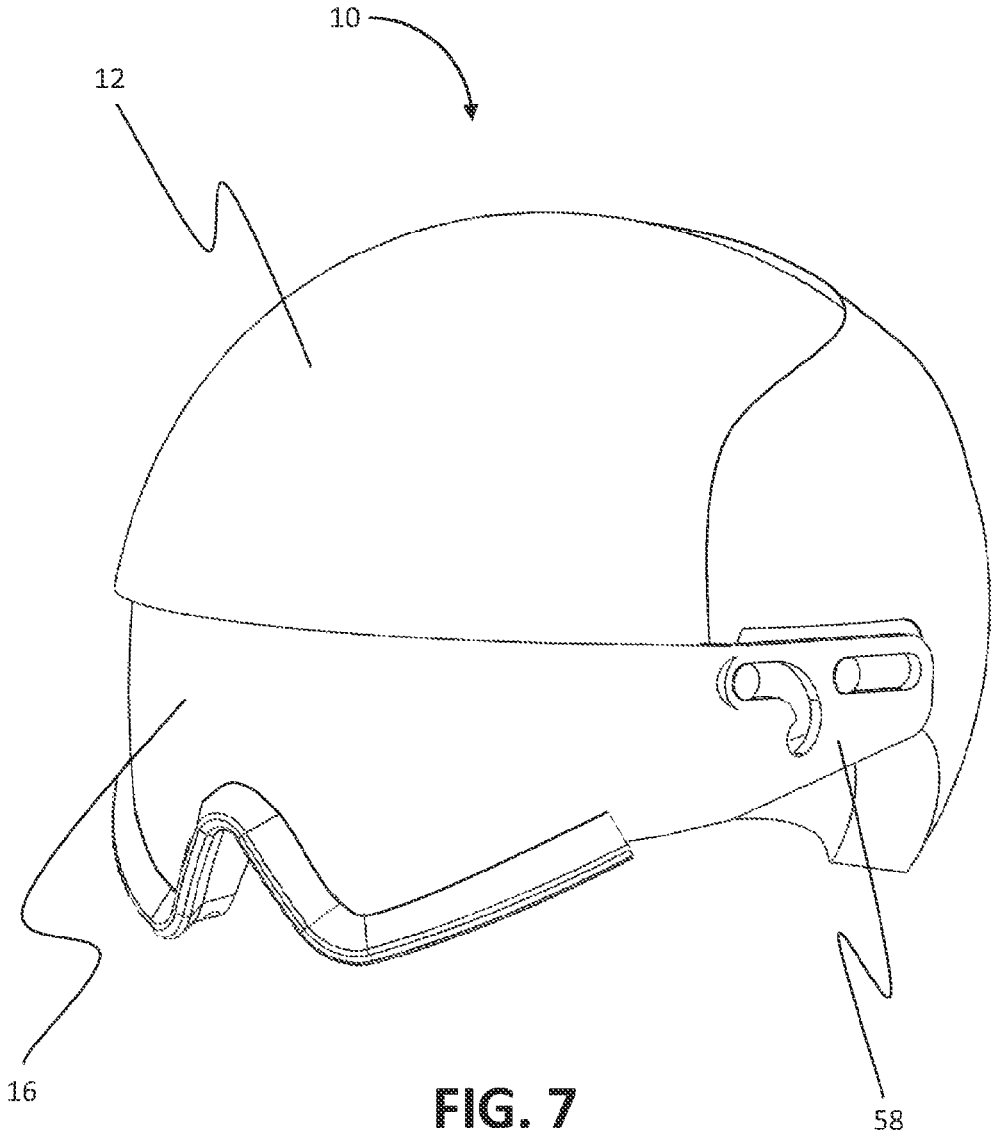
FIG. 7 is a axonometric view of a helmet in accordance with another embodiment of the present invention.
Figure 8A:
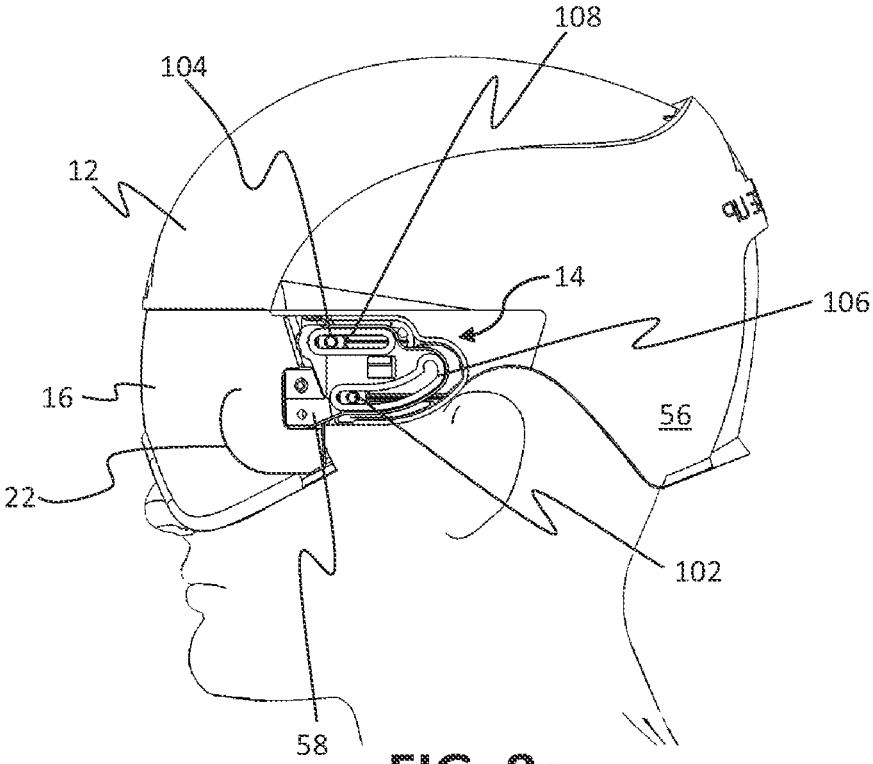
FIGS. 8*a* and 8*b* are side views of the helmet of FIG. 1 showing the detail of the left guiding mechanism as it guides the visor from the contacting position in 8*a* to the locked position in 8*b*, in accordance with another embodiment of the present invention.
Figure 8B:
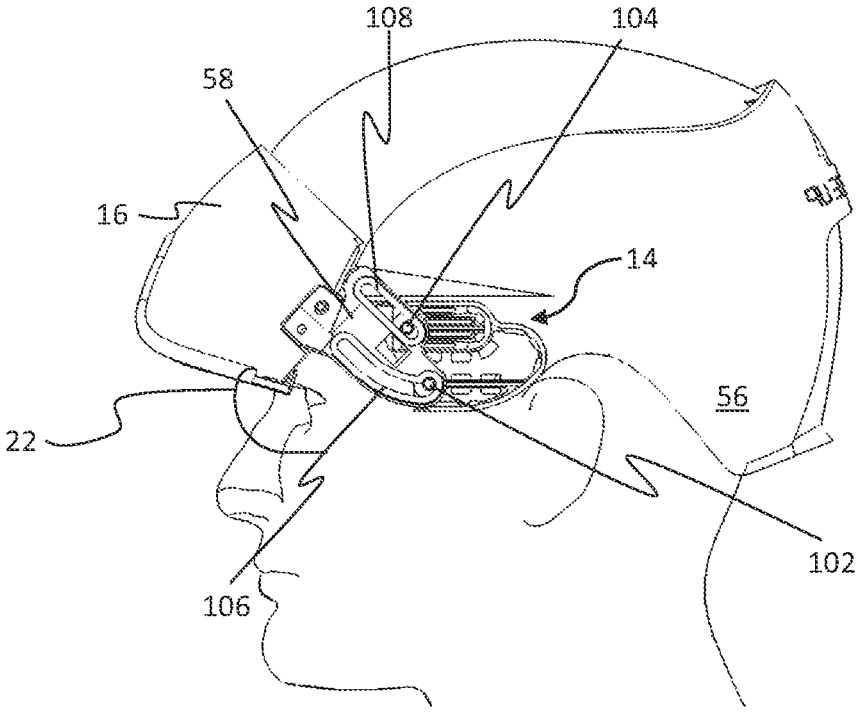

Each guiding mechanism 14 further comprises a visor adaptor 58 that removably connect each side of the visor 16 to a same side of the shell 12. The visor adaptor 58 is a mobile part of the guiding mechanism 14. The track arrangement 100 and the first and second pivots 102, 104 may be arranged in different ways. In a first combination, both the first and the second pivots 102, 104 may be located on the shell 12 while the track arrangement 100 is located on the visor adaptor 58. This is the combination depicted in FIG. 3. Conversely, in a second combination, the track arrangement 100 could be located on the shell 12 while the first and second pivots 102, 104 are located on the visor adaptor 58. This combination is depicted in FIGS. 8*a* and 8*b*. In a third combination, the first track portion 106 and the second pivot 104 are located on the shell 12 while the second track portion 108 and the first pivot 102 are located on the visor adaptor 58. This combination is depicted in FIGS. 9*a* and 9*b*. Finally, in a fourth combination, the first track portion 106 and the second pivot 104 are located on the visor adaptor 58 while the second track portion 108 and the first pivot 102 are located on the shell 12. This combination is depicted in FIGS. 7*a* and 7*b*. Elements of the guiding mechanism 14 that are located on the shell may be either integrated to the outer shell 18 or to the inner shell 20. Since the inner shell 20 is typically made of foam, the guiding mechanism 14 may comprise a base that is inserted in the foam of the inner shell 20. The elements to be located on the shell 12 would then be located on this base.

Advantageously, the visor adaptor 58 allows the easy removal of the visor 16 from the helmet 10. This could happen when, for example, the wearer wants to replace his visor 16 for one better adapted to a specific type of ambient lighting, or if the visor 16 becomes scratched. The visor adaptors 58 therefore conveniently provide a quick connection with the visor 16. Each visor adaptor 58 comprises a mounting interface 60 to removably connect the visor 16. Advantageously, this mounting interface 60 allows the visor 16 to be quickly removed from the visor adaptor 58, preferably without the use of tools.

The pre-determined trajectory 22 is determined by the specific geometry of the guiding mechanism 14, and in particular by the combined location of the first and second track portions 106, 108 and by the shape of the track arrangement 100. As shown in FIG. 3, the pre-determined trajectory 22 has two portions, a translation trajectory 90 and a deployment trajectory 92. Optionally, the trajectory 22 may also comprise a third portion: a locking trajectory 93. The trajectory 22 has sequentially an optional locked position 94, a retracted position 95, a deployed position 96, a contacting position 97 and a resting position 98.

The locked position 94 is an optional position where the visor 16 is locked into position under the force of a biasing means 72. The retracted position 95 is a position where the visor 16 is substantially proximate the front portion 52 of the shell 12 and substantially outside the field of view 54. The deployed position 96 is a position where the visor 16 is substantially below the frontal lower edge 53 and within the field of view 54 of the wearer. The contacting position is the location along the pre-determined trajectory 22 at which point the face seal 46 contacts the face of the wearer. The resting position 98 is the most rearward position the visor 16 can reach.

Advantageously, the pre-determined trajectory 22 may not be affected by the wearer using more or less force when he moves the visor 16. Indeed, because the geometry of the pre-determined trajectory 22 is solely determined by the guiding mechanisms 14 (which uses rigid components, except for the biasing means 72), the visor 16 will travel exactly along the intended pre-determined trajectory 22 and the visor 16 will not inadvertently move out of alignment or unwillingly contact another component of the helmet 10.

The biasing means 72 provides a biasing force to at least one of the guiding mechanisms 14. The biasing means 72 is placed between a non-moving part, such as the shell 12, and a moving part, such as the visor adaptor 58. The biasing means 72 may be different mechanisms such as a spring (coil or leaf), a rubber band, or any other biasing means known to a person skilled in the art. The biasing means 72 may be integrally designed with the guiding mechanism 14 or be an additional part.

The biasing means 72 is located so as to bias the visor 16 along the trajectory 22 from the retracted position 95 towards the deployed position 96, and further rearwardly towards the resting position 98, so that the face seal 46 is capable of substantially and predominantly perpendicularly contacting the face of the wearer with a pressure and ensures of an adequate seal when the visor 16 reaches the contacting position 97. Optionally, the biasing means 72 may be located so as to also bias the visor 16 towards the retracted position 95 and/or towards the locked position if the optional locking portion 114 is used.

Figure 4A:
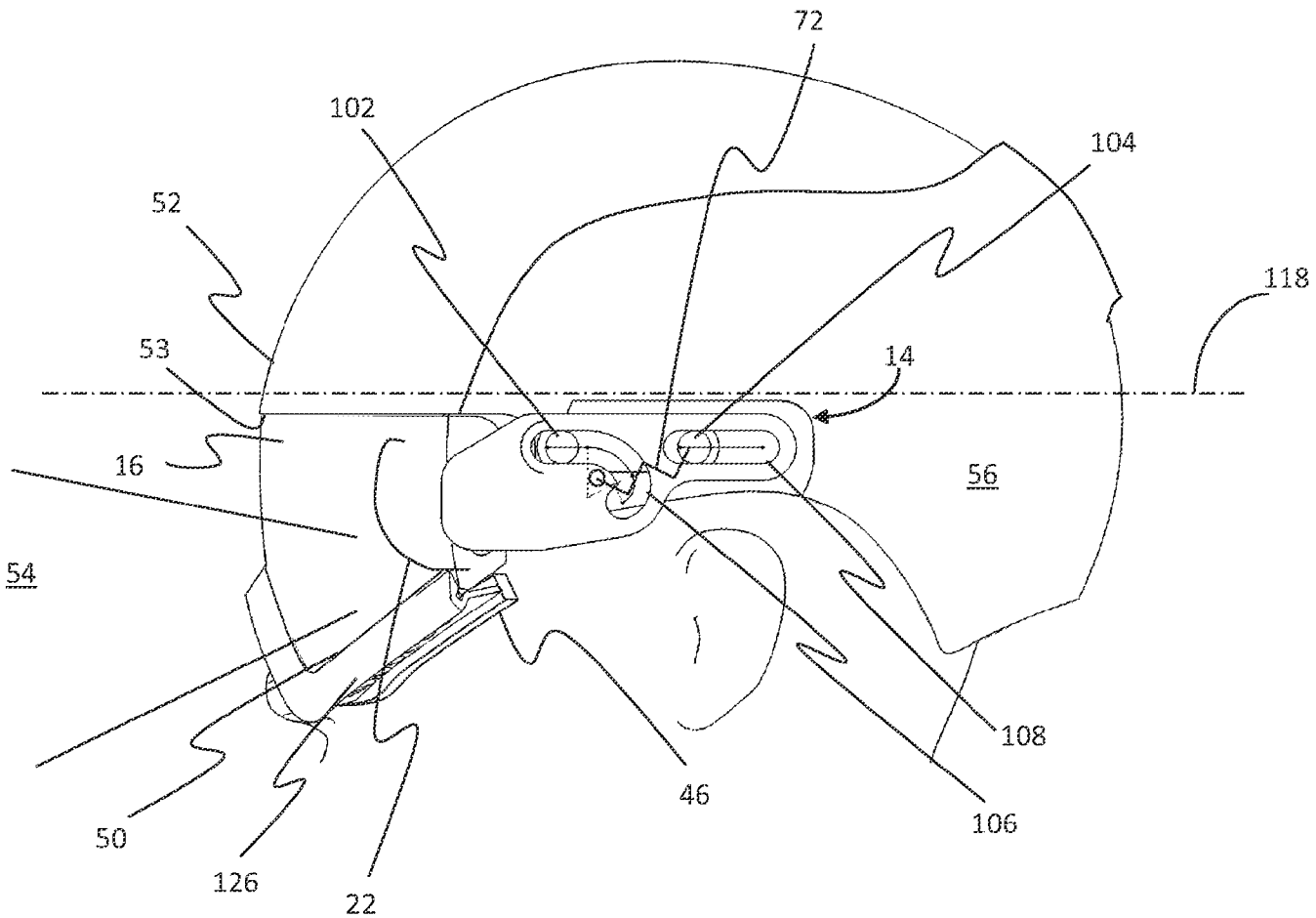
FIGS. 4*a* to 4*d* are side views of the helmet of FIG. 3 showing the detail of the left guiding mechanism as it guides the visor from the contacting position in 4*a* to the locked position in 4*d*, passing through the deployed position in 4*b* and the retracted position in 4*c;*
Figure 4B:
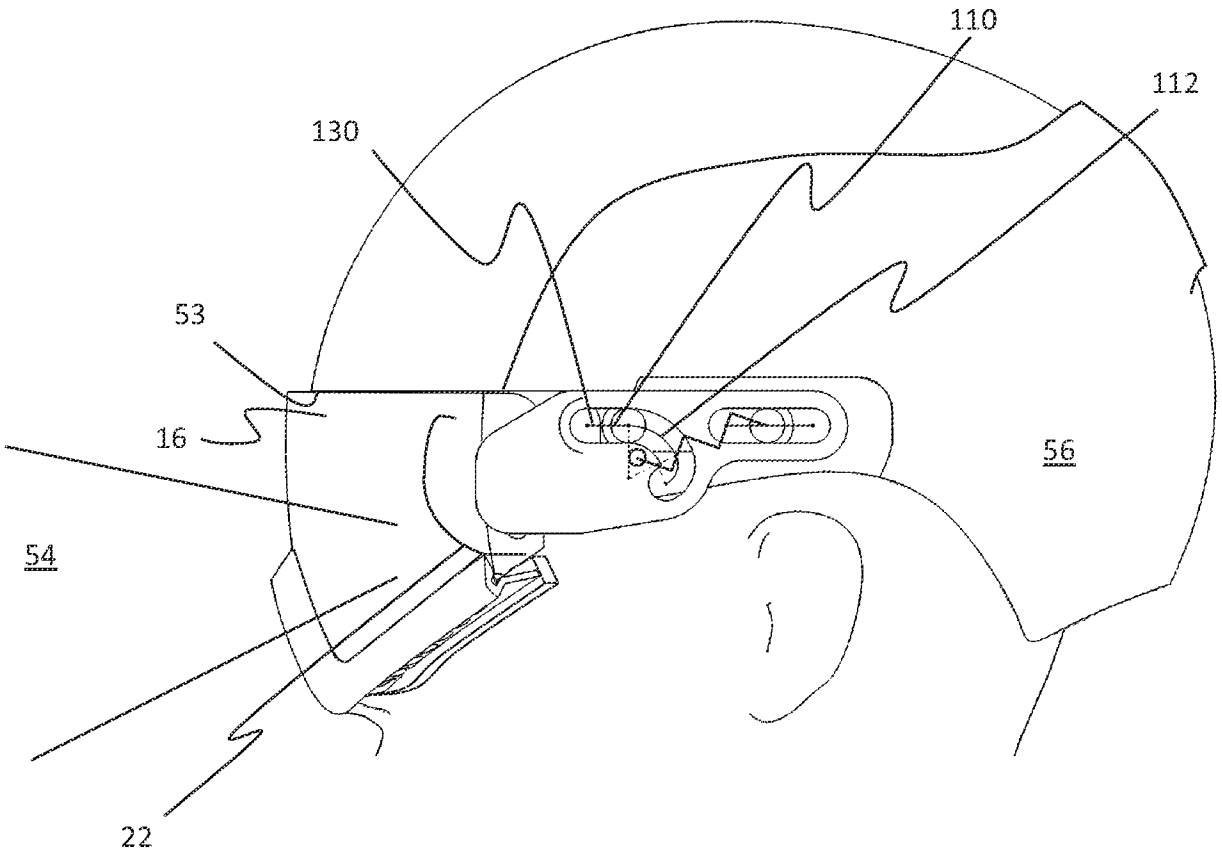
Figure 4C:
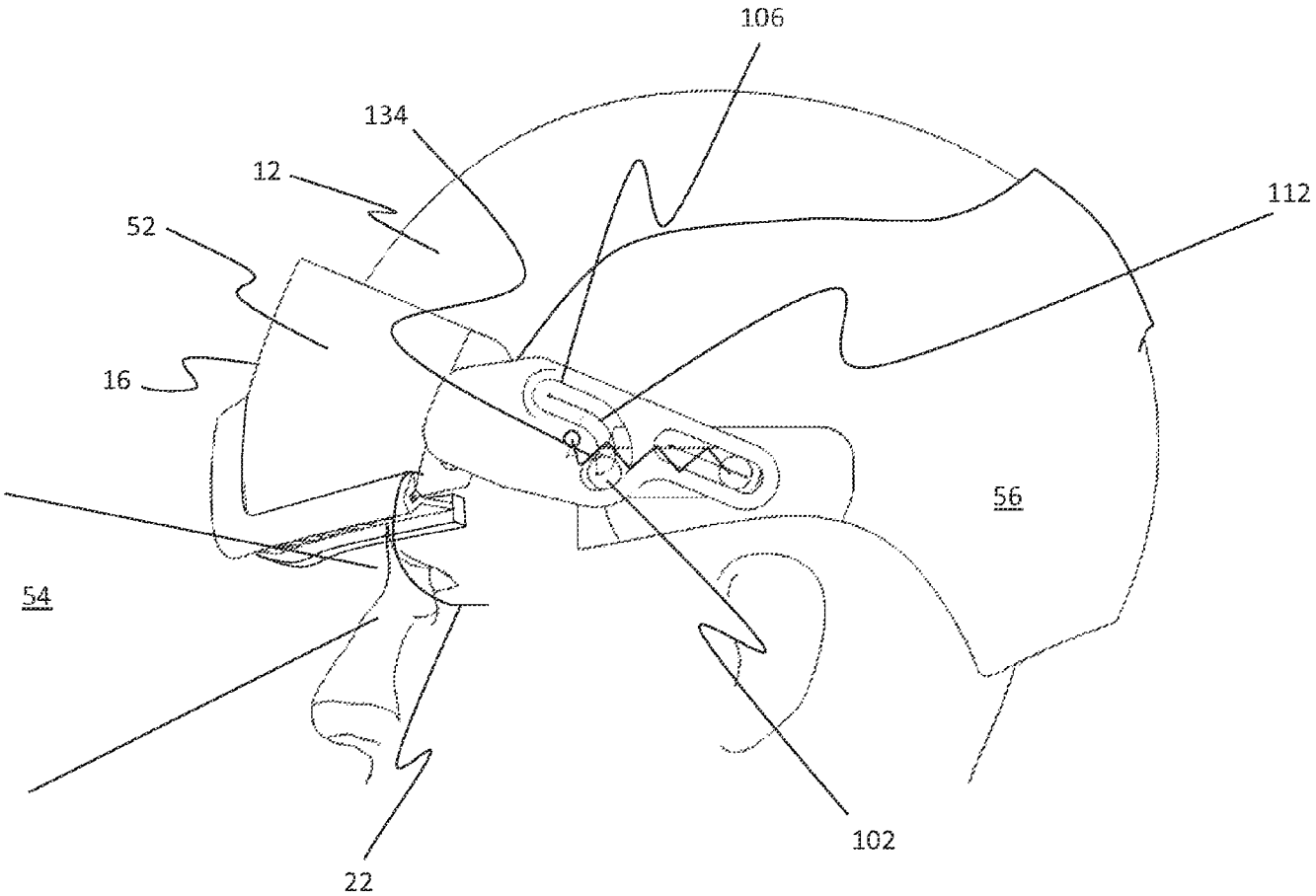

FIGS. 4*a* to 4*d*, now concurrently referred to, depict the movement of the visor 16 when the wearer moves it from its contacting position 97 (FIG. 4*a*) to its locked position (FIG. 4*d*), passing by the deployed position 96 (FIG. 4*b*) and the retracted position 95 (FIG. 4*c*). As can be observed, the visor 16 follows the pre-determined trajectory 22. In fact, every single virtual point on the visor 16 actually follows its own single pre-determined trajectory 22. For the sake of clarity, the pre-determined trajectory 22 depicted in all Figures is the trajectory followed by one virtual reference point located in a lower portion 50 of the visor 16, here more specifically on the lower frame 126.

When the first slider 102 is within the translation portion 110, the guiding mechanism 14 is operative to guide the visor 16 along the translation trajectory 90. The translation trajectory 90 extends substantially parallel to the longitudinal axis 118 and extends from the deployed position 96 to a resting position 98 aft of the deployed position 96.

The translation portion 90, corresponds to the movement of the visor 16 as determined by the corresponding linear portions 110, 111 of the first and second track portions 106, 108. When both the first and the second track portions 106, 108 have corresponding linear portions 110 and 111, and that both corresponding linear portions 110, 111 are predominantly parallel to the longitudinal axis 118, the visor 16 may move along a frontal lower edge 53 of the shell 12 at a substantially constant vertical distance. This may be observed in FIGS. 4*a* and 4*b*, now concurrently referred to. In FIG. 4*a*, the visor 16 is in its contacting position within the field of view 54 of the wearer and with the face seal 46 contacting the face of the wearer. The visor 16 is within the translation trajectory portion 90. In FIG. 4*b*, the visor 16 is at the deployed position 96. As can be observed, the visor 16 has been guided parallel to the lower edge 53 and parallel to the longitudinal axis 118 and at a constant vertical distance from the lower edge 53.

Advantageously, part of the translation portion 90 is used to accommodate different facial physiognomies of different wearers. Indeed, because of different wearers having difference facial appearances, the face seal 46 does not always contact different faces at the same position along the translation portion 90. Still, there is a need to provide a good seal not only between the face of the wearer and the visor 16, but also between the visor 16 and the shell 12. Hence, having both the corresponding linear portion 110, 111 predominantly parallel to the longitudinal axis 118 determines the translation portion 90 to be also predominantly parallel to the longitudinal axis 118 and in turn ensures that the face seal 46 contacts the face of the wearer predominantly perpendicularly, making a good seal under the biasing force developed by the biasing means 72 while simultaneously keeping a minimum clearance gap between the visor 16 and the shell 12, notwithstanding the facial appearances of different wearers.

When the first slider 102 is within the deployment portion 112, the guiding mechanism 14 is operative to guide the visor 16 along the deployment trajectory 92. The deployment trajectory 92 extends from the retracted position 95 where the visor 16 is substantially proximate a shell frontal portion 52 and substantially outside a field of view 54 of the wearer, to the deployed position 96 where the visor 16 is substantially below the frontal lower edge 53 and within the field of view 54 of the wearer.

As can be observed in FIG. 4*c*, the first slider 102 has moved in the first track portion 106 along the deployment portion 112 up to the retracted position 95. The deployment portion 112 is used to make the visor 16 clear the shell 12 and move it upwardly substantially proximate the front portion 52 of the shell 12. The deployment portion 112 is also used to make the visor 16 substantially clear the field of view 54.

Figure 4D:
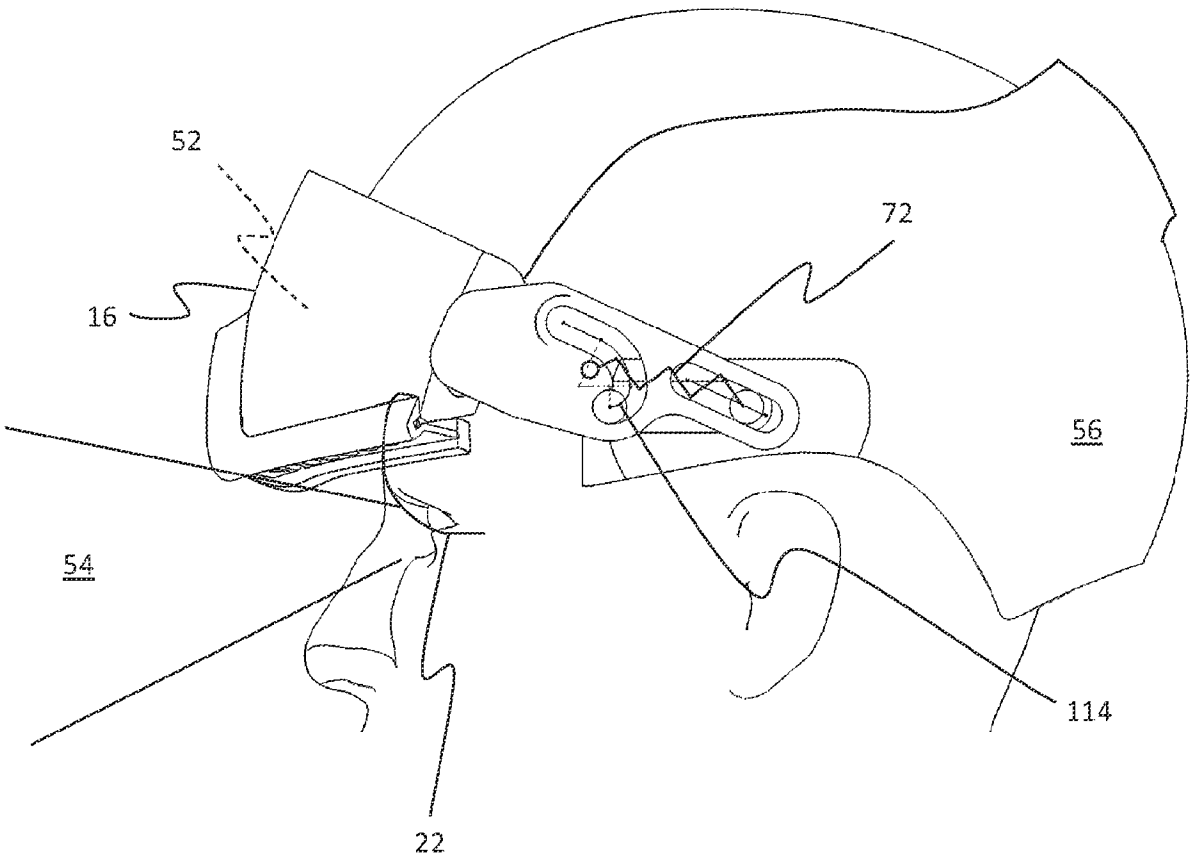

FIG. 4*d* depicts the visor 16 at the locked position 94. The locking portion 114 of the first track portion 106 is used to prevent the visor 16 from inadvertently moving back to its contacting position 97. As can be observed by comparing FIGS. 4*d* and 4*c*, the locking portion 114, although mainly used to lock the visor 16 in a position proximate the retracted position 95, has also contributed to the visor 16 further clearing the field of view 54. This locked position 94 may therefore be seen as a fully retracted position.

Figure 4E:
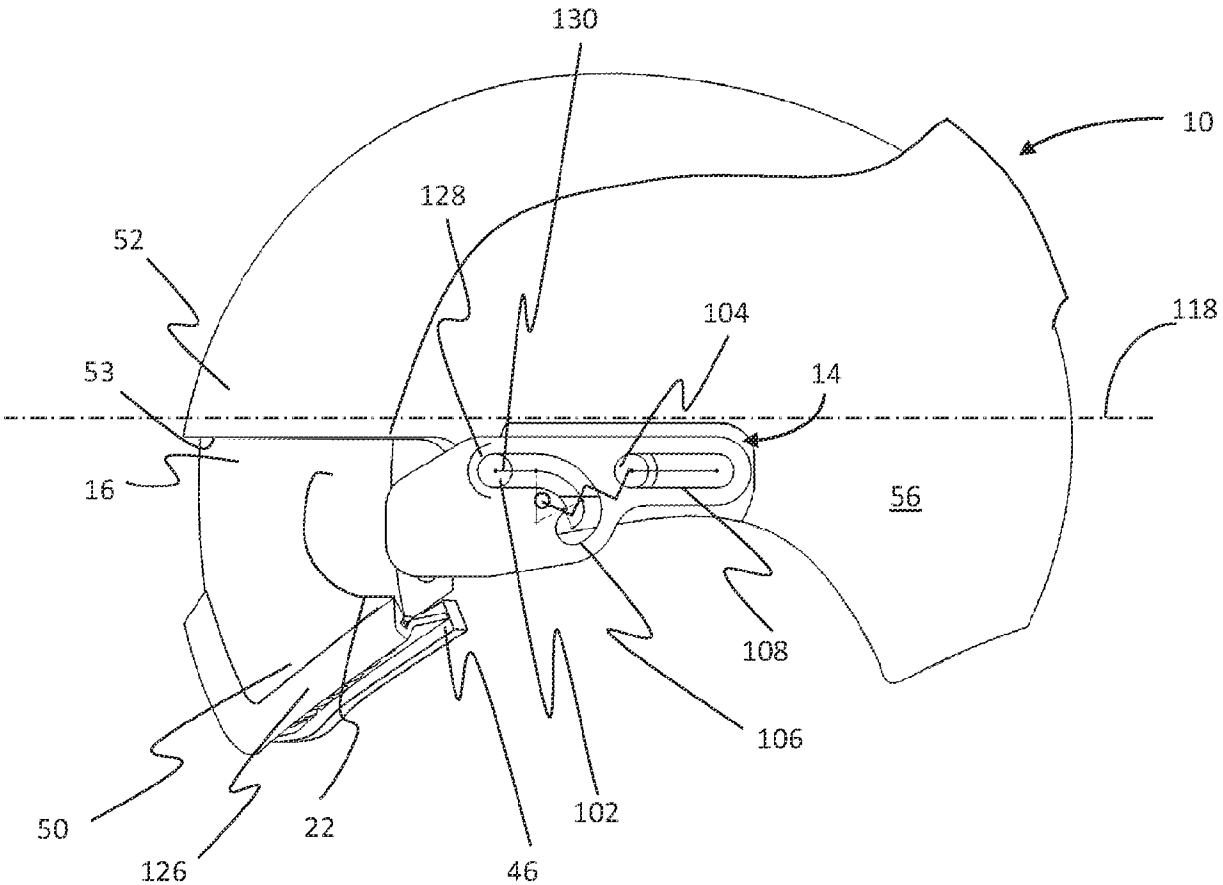
FIG. 4*e* is a side view of the helmet of FIG. 3 showing the guiding mechanism as it guided the visor to a resting position.

FIG. 4*e* depicts the helmet 10 when not in use, in a resting position 98. The helmet 10 comprises a stop 128 which defines the location of the resting position 98. As may be observed in FIG. 4*e*, the pre-determined trajectory 22 extends beyond both the deployed position 96 and the contacting position 97 and reaches the resting position 98. In FIG. 4*e*, the stop 128 is conveniently defined by one extremity of the first track portion 106, on which the first slider 102 abuts, thereby preventing the guiding mechanism 14 from guiding the visor 16 any further towards the rear portion 56 of the shell 12.

The locking portion 114 is oriented so that the biasing means 72 biases the first slider 102 towards the end of the locking portion 114 that is farthest from the deployment portion. FIGS. 4*a* to 4*e* show that the biasing means 72 is located so as to pull the visor 16 towards the retracted position 95, in 4*c*, and towards the deployed position 96 in 4*b* and further towards the contacting position 97 in 4*a* and even further towards the resting position 98 in 4*e*. The shift in the direction towards which the biasing means 72 pulls the visor 16 occurs when the first slider 102 passes over a fulcrum 134 shown in FIG. 4*c*. When the visor 16 is moved from the retracted position 95 as shown in FIG. 4*c* to the deployed position in 4*b*, the wearer first has to slightly pull on the visor 16 in order for the first slider 102 to move away from the end of the locking portion 114. Since the first slider 102 and the second slider 104 respectively engage the first track portion 106 and the second track portion 108, the wearer only has to move the visor 16 along the trajectory 22 imposed by the geometry of the guiding mechanism 14 and pull against the force developed by the biasing means 72 until the first slider 102 moves over the fulcrum 134. Then, the biasing means 72 pulls the visor 16 towards the deployed position 96 in FIG. 4*b* and further until the face seal 46 abuts the face of the wearer at the contacting position 97 in FIG. 4*a*. If the helmet 10 is not worn by a wearer, then the biasing means 72 will continue to pull the visor 16 until it reaches the resting position 98 as shown in FIG. 4*e*. The resting position 98 is determined by either the first slider 102 or the second slider 104 reaching the end of their respective track portion. Because the visor 16 reaches the contacting position 97 before the resting position 98, the visor 16 is always under the biasing force developed by the biasing means 72 when the face seal 46 contacts the face of the wearer. This provides an adequate seal against elements intrusion between the lens 51 and the eyes of the wearer.

FIG. 5*a* is now referred to. Advantageously, the helmet 10 may be further equipped with an upper seal 122 to seal the visor upper portion 55 against the shell 12. The upper seal 122 may be connected to either the shell 12 or the visor upper portion 55. The visor 16 contacts the shell 12 through the upper seal 122 when the visor 16 gets in the vicinity of the contacting position 97 and retains this contact up to the resting position 98. When the visor 16 is in the resting position 98, the upper seal 122 is located below and at least partially recessed from the frontal lower edge 53. As is shown in FIG. 5*a*, the upper seal 122 is placed on the inner shell 20. Alternatively, the upper seal 122 could be placed on the visor upper portion 55, whether the visor upper portion 55 is equipped with a visor upper frame 124 or not. As can be seen, the upper seal 122 has a hollow "D" cross section, allowing the visor 16 to seal against the shell 12 over a portion of the trajectory 22, more precisely preferably from the contacting position 97 to the resting position 98. A person skilled in the art could easily envision that the upper seal 122 could be a hollow seal, a soft foam, a lip seal, or many other appropriate seal designs that will allow sealing even though the visor 16 and the shell 12 are not exactly at the same position one with respect to the other.

Figure 5B:
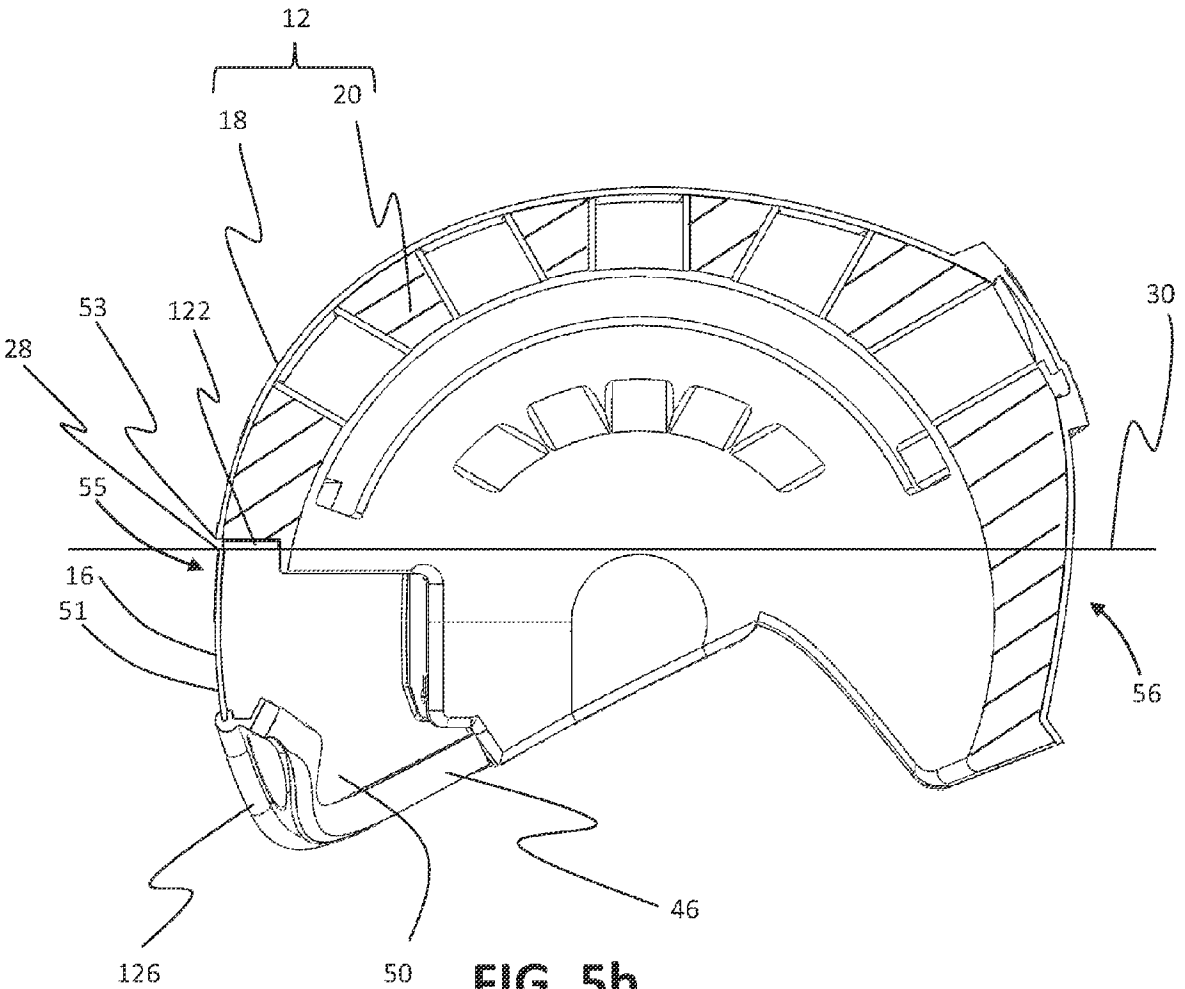
FIG. 5*b* is a cross-section view of a helmet showing an upper seal adapted to seal in a transverse plane in accordance with an embodiment of the present invention.

FIG. 5*b* depicts an example of a variant of upper seal 122. In this embodiment, the upper seal 122 is mostly flat and could be, for example, made of foam or felt. The upper seal 122 is adapted to seal against an upper edge 28 of the visor 16 in a transverse plane 30. In use, as the visor 16 is moved predominantly horizontally and towards the rear portion 56 of the shell 12, the upper seal 122 rubs against the upper edge 28 and seals. As shown in FIG. 5*b*, the upper seal 122 is about to rub against the upper edge 28 as the visor 16 will be moved further towards the rear portion 56.

Advantageously, because the visor 16 cannot be deviated by human force from the pre-determined trajectory 22 along which it moves, the sealing may be more precisely maintained both between the visor 16 and the face of the wearer at the visor lower portion 50 and between the visor 16 and the shell 12 at the visor upper portion 55.

Figure 6A:
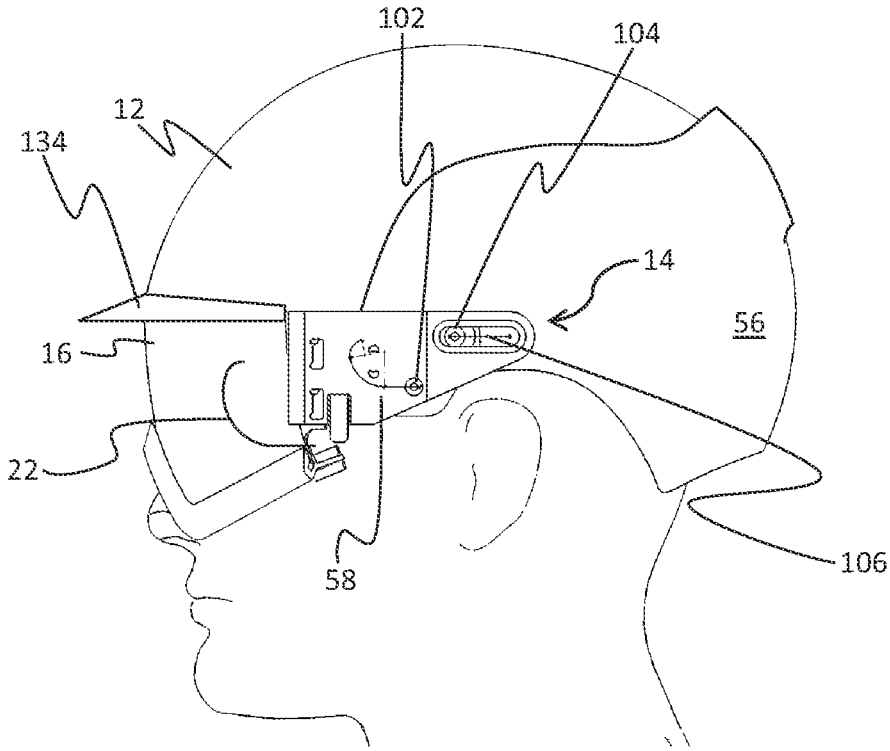
FIGS. 6*a* and 6*b* are side views of a helmet with a sun visor in accordance with another embodiment of the present invention.
Figure 6B:
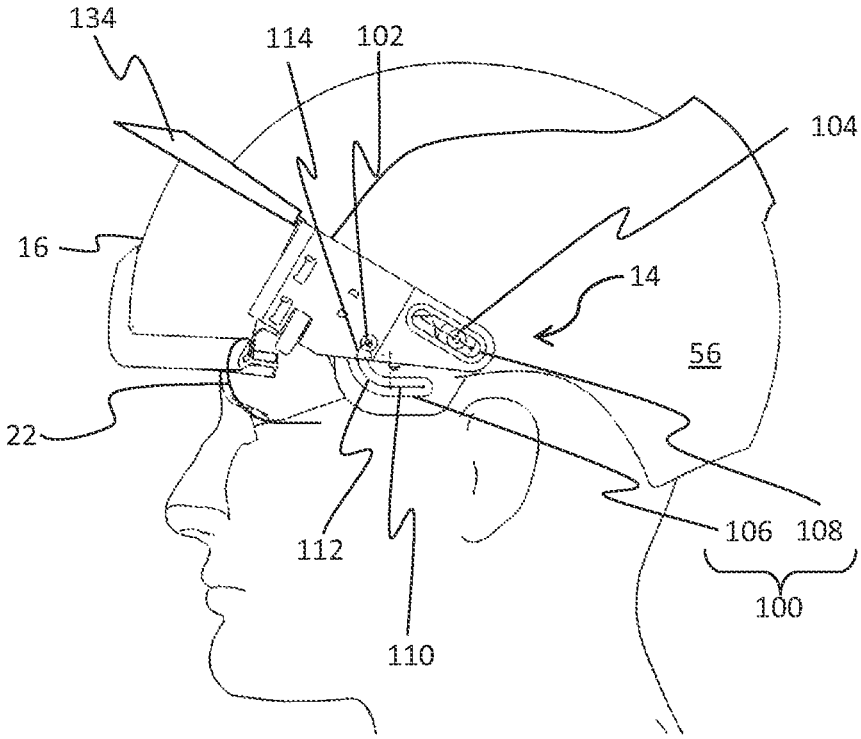

As shown in FIGS. 6*a* and 6*b*, now referred to, a sun visor 134 protruding towards the front of the helmet 10 may also be used. When the helmet 10 is so equipped, the sun visor 134 is preferably attached to the visor upper portion 55 or to the upper frame 124 so that the sun visor 134 is capable of moving with the visor 16. If the sun visor 134 is higher than the frontal lower edge 53 when the visor 16 is in the deployed position, the sun visor 134 needs to be provided with sufficient clearance so that it does not abut against the shell 12 before the face seal 46 contacts the face of the wearer FIG. 7 is now referred to. Although it is convenient to removably mount the visor 16 to the visor adaptor 58, the visor 16 could be permanently attached to the visor adaptors 58 on each side of the shell 12. In fact, the visor 16 and the two visor adaptors could be made of a single component such as the visor 16 of FIG. 7 and some guiding features of the guiding mechanism 14 could be integrated directly into the visor 16. In the example provided in FIG. 7, the guiding track arrangement 100 has been directly integrated in the sides of the visor 16. Alternatively, the first and second sliders 102, 104 could have been integrated in the visor 16, or a combination of the first slider 102 and the second track portion 108 or the first track portion 106 and the second slider 104. The biasing means is then directly connected to the visor 16.

It may be noted that different geometries of the guiding track arrangement 100 may be used to position the visor 16 according to specific requirements or preferences. Indeed, different combinations of shapes and positions of the first track portion 106 and of the second track portion 108 may be used that will provide an adequate positioning of the visor 16. Moreover, the first and second track portions 106, 108 and the first and second sliders 102, 104 may either be positioned on the shell 12, on the visor adaptor 58 or on the visor 16 when the visor integrates the visor adaptors.

Although many variations may be used, an examples of such variations is depicted in FIGS. 4*a*, 4*d*, 7*a*, 7*b*, 8*a*, 8*b*, 6*a* and 6*b*. Each set of Figures respectively depict the deployed position and the retracted position of a different embodiment of the present invention. With the exception of FIGS. 8*a* and 8*b*, for clarity, the biasing means 72 have been omitted in these Figures. The biasing means 72 would be connected between the shell 12 and the visor adaptor 58 similarly to what is shown in FIG. 3.

FIGS. 4*a* and 4*d* depict an embodiment of the helmet 10 where the guiding track arrangement 100 is located in the visor adaptor 58. The deployment portion 112 is curved rearwardly and downwardly from the translation portion 110 and the locking portion is oriented towards the front portion 52 of the shell 12. The first slider 102 and the second slider 104 are connected to the shell 12.

FIGS. 6*a* and 6*b* are now referred to. FIGS. 6*a* and 6*b* depict an embodiment of the helmet 10 where the first track portion 106 and the second slider 104 are located on the shell 12 and where the first slider 102 and the second track portion 108 are located on the visor adaptor 58. The deployment portion 112 is curved forwardly and upwardly from the translation portion 110 and the locking portion is oriented towards the rear portion 56 of the shell 12.

FIGS. 7*a* and 7*b* are now referred to. FIGS. 7*a* and 7*b* depict an embodiment of the helmet 10 where the first track portion 106 and the second slider 104 are located on the visor adaptor 58 and where the first slider 102 and the second track portion 108 are connected to the shell 12. The deployment portion 112 is curved downwardly from the translation portion 110 and the locking portion is oriented towards the front portion 52 of the shell 12. The first track portion 106 and the second slider 104 could alternatively be located on the visor 16 if the visor adaptor 58 was not used.

FIGS. 8*a* and 8*b* are now referred to. FIGS. 8*a* and 8*b* depict an embodiment of the helmet 10 where the guiding track arrangement 100 is located in the visor adaptor 58. The deployment portion 112 is curved rearwardly and upwardly from the translation portion 110 and the locking portion 114 is oriented towards the front portion 52 of the shell 12. The first slider 102 and the second slider 104 are connected to the shell 12. The first slider 102 is located below and aft of the second slider 104.

The present invention has been described with regard to preferred embodiments. The description as much as the drawings were intended to help the understanding of the invention, rather than to limit its scope. It will be apparent to one skilled in the art that various modifications may be made to the invention without departing from the scope of the invention as described herein, and such modifications are intended to be covered by the present description. The invention is defined by the claims that follow.

I claim:

1. A helmet comprising:

a shell, said shell being adapted to contact a wearer's head, said shell having a shell front portion, said shell front portion having a frontal lower edge, a visor, said visor having a visor lower portion and a visor upper portion;

a face seal, said face seal being connected to said visor lower portion;

a biasing means; and two guiding mechanisms, each one of said two guiding mechanisms being located on a different side of said shell and connecting said visor to said shell, said guiding mechanisms being operative to guide said visor along a pre-determined trajectory defined by said guiding mechanisms, said pre-determined trajectory having a deployment trajectory and a translation trajectory, each one of said two guiding mechanisms further having:

a guiding track arrangement, said guiding track arrangement having a first track portion and a second track portion, said first track portion having a deployment portion and a translation portion, said translation portion and said second track portion at least partly extending substantially parallel to a longitudinal axis of said shell;

a first slider, said first slider slidingly engaging said first track portion;

a second slider, said second slider slidingly engaging said second track portion, wherein said guiding mechanisms are operative to guide said visor along said deployment trajectory when said first slider is within said deployment portion of said first track portion, said deployment trajectory extending from a retracted position where said visor is substantially proximate said front portion of said shell and substantially outside a field of view of the wearer to a deployed position where said visor is substantially below said frontal lower edge and within the field of view of the wearer, said guiding mechanisms being further operative to guide said visor along said translation trajectory when said first slider is within said translation portion of said first track portion, said translation trajectory extending substantially parallel to said longitudinal axis of said shell, said translation trajectory extending from said deployed position to a resting position aft of said deployed position, said biasing means being operative to bias said visor towards said deployed position and further towards said resting position so that in use said face seal is operative to substantially perpendicularly contact a face of the wearer thereby defining a contacting position, said contacting position being located along said translation trajectory between said deployed position and said resting position.

2. The helmet of claim 1 further comprising an upper seal, said upper seal being connected to one of said shell and said visor upper portion, said upper seal being located below and at least partially recessed from said frontal lower edge when said visor is in said resting position, said upper seal being operative to seal said visor upper portion against said shell.

3. The helmet of claim 2 wherein said upper seal is adapted to seal in a transverse plane.

4. The helmet of claim 2 wherein said shell further comprises an outer shell and an inner shell inside said outer shell, said inner shell being made of an impact-absorbing material, said upper seal being connected to said inner shell.

5. The helmet of claim 2 wherein said first track portion further comprises a locking portion connected to said deployment portion, said locking portion being oriented so that said biasing means biases said first slider towards the end of said locking portion distal said deployment portion.

6. The helmet of claim 2 wherein each of said guiding mechanisms further comprises a visor adaptor, said visor being removably connected to said shell through said visor adaptor, said biasing means connecting said visor adaptor to said shell.

7. The helmet of claim 6 wherein said first track portion is located on said visor adaptor and said first slider is located on said shell.

8. The helmet of claim 7 wherein said second track portion is located on said visor adaptor and said second slider is located on said shell.

9. The helmet of claim 8 wherein said first slider is located below and aft of said second slider, said deployment portion being curved upwardly and rearwardly from said translation portion.

10. The helmet of claim 8 wherein each of said guiding mechanisms further comprises a base, said base being inserted in said inner shell, said first slider and said second slider being located on said base.

11. The helmet of claim 2 wherein said visor further comprises a lower frame running along said visor lower portion, said face seal being connected to said lower frame, said lower frame having a ventilation opening.

12. A helmet for a wearer, the helmet comprising:

a shell:

a visor;

a face seal, said face seal being connected to a lower portion of said visor;

two guiding mechanisms, each one of said two guiding mechanisms being located on a different side of said shell and connecting said visor to said shell, each one of said guiding mechanisms having a guiding track arrangement, said guiding track arrangement comprising a first track portion and a second track portion, said first track portion having a deployment portion and a translation portion, said translation portion and said second track portion at least partially extending substantially parallel to a longitudinal axis of said shell, each one of said guiding mechanisms further comprising a first slider and a second slider, said first slider slidingly engaging said first track portion and said second slider slidingly engaging said second track portion, each one of said guiding mechanism being operative to guide said visor along a pre-determined trajectory; and a biasing means, said biasing means being operative to bias said visor along said pre-determined trajectory, wherein said pre-determined trajectory extends from a retracted position where said visor is substantially proximate a front portion of said shell and substantially outside a field of view of the wearer to a contacting position where said visor is substantially below a frontal lower edge of said front portion of said shell and within the field of view of the wearer, said pre-determined trajectory extending substantially parallel to said longitudinal axis of said shell proximate said contacting position, said biasing means being operative to bias said visor towards said contacting position so that said lower seal is operative to substantially perpendicularly contact a face of the wearer under the bias of said biasing means.

13. The helmet of claim 12 further comprising an upper seal, said upper seal being connected to one of said shell and an upper portion of said visor, said upper seal being located below and at least partially recessed from said frontal lower edge when said visor is in said contacting position, said upper seal being operative to seal said visor upper portion against said shell.

14. The helmet of claim 13 wherein said upper seal is adapted to seal in a transverse plane.

15. The helmet of claim 13 wherein said shell further comprises an outer shell and an inner shell inside said outer shell, said inner shell being made of an impact-absorbing material, said upper seal being connected to said inner shell.

16. The helmet of claim 12 wherein said first track portion further comprises a locking portion connected to said deployment portion, said locking portion being oriented so that said biasing means biases said first slider towards the end of said locking portion distal said deployment portion.

17. The helmet of claim 12 wherein each one of said guiding mechanisms further comprises a visor adaptor, said visor being removably connected to said shell through said visor adaptor, said biasing means connecting said visor adaptor to said shell.

18. The helmet of claim 16 wherein said first track portion and said second track portion are located on said visor adaptor and said first slider and said second slider are located on said shell.

19. The helmet of claim 18 wherein said first slider is located below and aft of said second slider, said deployment portion being curved upwardly and rearwardly from said translation portion.

* * * * *